US006378346B1

(12) United States Patent
Sudau et al.

(10) Patent No.: US 6,378,346 B1
(45) Date of Patent: Apr. 30, 2002

(54) STECKEL HOT ROLLING MILL

(75) Inventors: Peter Sudau, Hilchenbach; Olaf Norman Jepsen, Siegen, both of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/673,691

(22) PCT Filed: Apr. 20, 1999

(86) PCT No.: PCT/EP99/02652

§ 371 Date: Feb. 5, 2001

§ 102(e) Date: Feb. 5, 2001

(87) PCT Pub. No.: WO99/55474

PCT Pub. Date: Nov. 4, 1999

(30) Foreign Application Priority Data

Apr. 23, 1998 (DE) ..... 198 18 207

(51) Int. Cl.[7] ..... B21B 37/48
(52) U.S. Cl. ..... 72/8.6; 72/11.4; 72/229
(58) Field of Search ..... 72/8.6, 11.4, 12.3, 72/201, 205, 229

(56) References Cited

U.S. PATENT DOCUMENTS 2,590,491 A 3/1952 Bendz
5,540,074 A * 7/1996 Smith et al. ..... 72/229
5,660,070 A * 8/1997 Muryn et al. ..... 72/229
5,701,774 A * 12/1997 Imanari et al. ..... 72/8.6
5,921,127 A * 7/1999 Ogawa et al. ..... 72/201

FOREIGN PATENT DOCUMENTS

| | | |
|---|---|---|
| DE | 1018019 | 4/1956 |
| DE | 4243045 | 7/1993 |
| EP | 0477422 | 4/1992 |

OTHER PUBLICATIONS

Patent Abstracts of Japan, vol. 012, No. 241 (M0716), Jul. 8, 1988 & JP 63 033116 A (Hitachi Ltd), Feb. 12, 1988.

* cited by examiner

*Primary Examiner*—Ed Tolan
(74) *Attorney, Agent, or Firm*—Friedrich Kueffner

(57) ABSTRACT

The invention relates to a Steckel hot rolling mill comprising at least one reversing roll stand (1) as well as coilers (6,7) which are positioned upstream and downstream and present torque-controlled drives. The aim of the invention is to improve such a hot rolling mill in such a way that it optimally counteracts variations in tension and/or mass flow caused by changes in process parameters and allows for high quality hot rolling, especially of very thin hot rolled strips. To this end the invention provides for a looper (8,9) to be positioned between both the coilers (6,7) and the reversible roll stand (1), which supplies actual values for adjusting tension and mass flow.

6 Claims, 1 Drawing Sheet

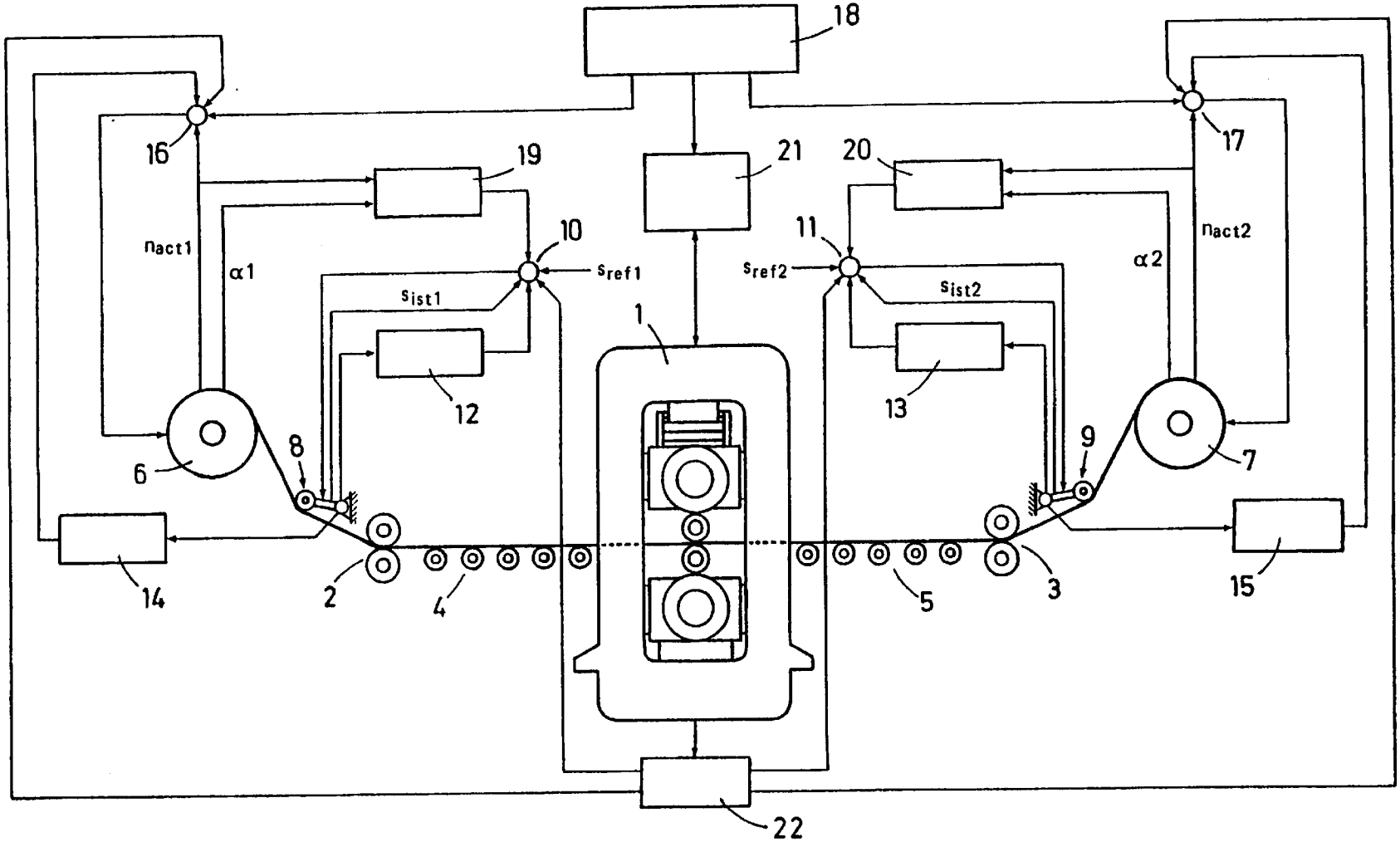
1
2
3
4
5
6
7
8
9
10
11
12
13
14
15
16
17
18
19
20
21
22
$n_{act1}$
$n_{act2}$
$\alpha 1$
$\alpha 2$
$s_{ist1}$
$s_{ist2}$
$s_{ref1}$
$s_{ref2}$

STECKEL HOT ROLLING MILL

BACKGROUND OF THE INVENTION

1. Field of the Invention

The invention relates to a Steckel hot rolling mill with at least one reversing roll stand, and coilers with torque-controlled drives positioned upstream and downstream of the roll stand.

2. Description of the Related Art

Steckel hot rolling mills of this type have torque-controlled coilers wherein, however, the control for achieving constant torques during the operation, particularly during rolling of hot-rolled strips, leads to insufficient rolling results. In such coilers with their partially large, inert masses, tension variations occur in the strip during the acceleration or deceleration phases at the strip beginning or the strip end or in the case of mass flow defects, wherein the variations cannot be regulated by the torque control, so that the known plants are only permitted to be operated with limited deceleration or acceleration. Such a limited acceleration or deceleration results in longer reversing times, lower rolling speeds and, thus, colder strip beginnings or strip ends which, in turn, require higher rolling forces. Substantial changes of the process variables, such as temperature, rolling force, together with loss of tension due to coiler unbalances and mass flow changes, lead to losses of quality and stability, such as, for example, out-of-center travel of the strip.

SUMMARY OF THE INVENTION

Therefore, the invention is based on the object of further developing a Steckel hot rolling mill of the above type in such a way that changes of the process variables due to changes of tension and/or mass flow can be counteracted in an optimum manner and that it is especially possible to roll thin hot-rolled strip with uniform, high quality.

To this end, it is proposed that a looper each is provided between the coilers and the reversing stand, wherein each looper supplies actual values for a tension control and a mass flow control. Consequently, certain tensions can be adjusted on each side of the reversing roll stand through the two loopers. If mass flow changes occur at the strip entry side or the strip exit side which are characterized essentially by changes of the strip speed, a mass flow control is effected by controlling the strip coiling speed or rate of rotation of the coiler for achieving an adjustment of the mass flow to a desired value.

It is an advantage if the loopers have a torque control effecting a constant strip tension, wherein a correction value is added to the torque control in dependence on the looper angle. It is further advantageous if a mass flow computer determines in dependence on the looper angle speed correction values for a control of the rate of rotation of the coiler. The mass flow control added to the tension control makes it possible to regulate high-frequency defects.

If the coilers are equipped with preliminary mass flow control and/or a preliminary mass flow regulation, it is ensured that changes, for example, of the desired thickness values or changes in the roll stand geometry, can already be regulated prior to the occurrence of tension or mass flow changes which would be recognized by the loopers.

Another advantage is to be seen in the fact that the coiler shafts are provided with angle transmitters which make it possible to determine deviations of the coiling or uncoiling speeds which are supplied to the tension regulators of the strip as preliminary control variables. This makes it possible that tension or mass flow changes resulting from eccentricities of the coilers can be taken into consideration during a preliminary control for regulating the loopers, without having to have the errors caused by the eccentricity recognized by the looper and only then having to regulate out these errors subsequently.

Essential for the operation of the Steckel hot rolling mills according to the present invention is the fact that low-inertia mass-optimized loopers which follow high-frequency changes are used. By using a special geometry and components of the loopers which are optimized with respect to their mass, it is achieved that these loopers can follow very rapid changes in tension or mass flow so that the errors measured in this manner can be counteracted by the corresponding control circuits.

BRIEF DESCRIPTION OF THE DRAWING

In the Drawing:

The single figure of the drawing shows a Steckel hot rolling mill according to the present invention.

As shown in the drawing, a reversing roll stand 1 is arranged between two drivers 2, 3. Roller conveyors 4, 5 are provided between the drivers 2, 3. Arranged upstream and downstream of the drivers are coilers 6, 7, wherein loopers 8, 9 are placed between the coilers 6, 7 and the drivers 2, 3.

DESCRIPTION OF THE PREFERRED EMBODIMENTS

Each looper 8, 9 is provided with a tension controller 10, 11. The tension controllers 10, 11 are supplied with tension frequency values $S_{ref1}$, $S_{ref2}$. Picked up at the loopers 8, 9 are actual force values corresponding to tensile stresses as actual tension values $S_{ist1}$, $S_{ist2}$. as well as angles which, after conversion in corresponding tensile stress correction computers 12, 13, are supplied to the tension controllers 10, 11 as tensile stress correction values. The tensile stress control circuits 10, 11 supply the result of the desired/actual value comparison to, for example, adjustment cylinders, not shown, of the loopers 8, 9.

The signals which are picked up at the loopers 8, 9 and correspond to angle positions are supplied to mass flow computers 14, 15 and are converted in these mass flow computers 14, 15 into rate of rotation correction values which, in turn, are supplied to rate of rotation controllers 16, 17. The rate of rotation controllers 16, 17 for the coilers 6, 7 are supplied with desired values through an input device 18. Actual rate of rotation values $n_{act1}$, $n_{act2}$ are picked up at the coilers 6, 7 and supplied to the rate of rotation controllers 16, 17. The rates of rotation for the coilers 6, 7 are determined in the rate of rotation computers 16, 17 from the desired values, the actual values and the correction values. When mass flow changes are determined, the rate of rotation of the coilers can be easily corrected by the mass flow control which is superimposed on the rate of rotation control of the coilers 6, 7.

In addition to the rate of rotation pickups, not shown, of the coilers 6, 7, the coilers are additionally provided with angle transmitters. The actual values of the current rate of rotation $n_{act1}$, $n_{act2}$, as well as the corresponding angles 1, 2, are converted in correction value computers 19, 20 into strip tension correction values which are supplied to the tension controllers 10, 11, so that, for example, tension changes caused by eccentricities can be supplied to the tension controllers 10, 11 for effecting a preliminary control.

The reversing roll stand 1 is provided with a rolling speed regulating device 21 which receives its desired values also from the input device 18. The input device 18 has a correction computer which, for effecting a preliminary control of the coilers 6, 7, converts, for example, supplied desired thickness values for the reversing roll stand 1 into corresponding preliminary control rates of rotation which can be supplied to the rate of rotation controllers 16, 17.

Material flow changes and/or tension changes resulting from adjustment changes or changes of the material can be supplied to a correction computer 22 which supplies tension correction values and/or rate of rotation correction values to the tension controllers 10, 11 and/or to the rate of rotation controllers 16, 17. This makes it also possible to achieve a preliminary mass flow control of the Steckel hot rolling mill in dependence on changing parameters of the reversing roll stand 1.

What is claimed is:

1. A Steckel hot rolling mill comprising at least one reversing roll and coilers provided with torque-controlled drivers arranged upstream and downstream of the roll stand, further comprising a looper each provided between one of the coilers and the reversing roll stand, wherein each looper is configured to provide actual values for a tension control and for a mass flow control.

2. The Steckel hot rolling mill according to claim 1, wherein each looper comprises a torque control for effecting a constant strip tension, means for supplying to the torque control correction values determined in dependence on the looper angle through tensile stress correction computers, and a mass flow computer for determining in dependence on the lopper angle speed correction values for a control of the rate of rotation of the coilers.

3. The Steckel hot rolling mill according to claim 1, wherein the coilers comprise a preliminary mass flow control.

4. The Steckel hot rolling mill according to claim 1, wherein the coilers comprise a preliminary mass flow regulation.

5. The Steckel hot rolling mill according to claim 1, wherein the rolling mill comprises coiler shafts, and wherein the coiler shafts are provided with angle transmitters configured to determine deviations of the coiling or uncoiling speeds, wherein the deviations are supplied to tension controllers of the strip as error values.

6. The Steckel hot rolling mill according to claim 1, wherein the loopers are low-inertia, mass-optimized loopers which follow high-frequency channels.

* * * * *